US008827513B2

(12) United States Patent
Chen et al.

(10) Patent No.: US 8,827,513 B2
(45) Date of Patent: Sep. 9, 2014

(54) PROXIMITY TOUCH SENSOR CABLE WITH A LIGHT EMITTING DIODE

(71) Applicant: Superior Communications, Irwindale, CA (US)

(72) Inventors: George Chen, Chatsworth, CA (US); Samuel Sentosa, Chino, CA (US)

(73) Assignee: Superior Communications, Inc., Irwindale, CA (US)

( * ) Notice: Subject to any disclaimer, the term of this patent is extended or adjusted under 35 U.S.C. 154(b) by 200 days.

(21) Appl. No.: 13/658,734

(22) Filed: Oct. 23, 2012

(65) Prior Publication Data

US 2014/0112005 A1 Apr. 24, 2014

(51) Int. Cl.
*F21S 13/02* (2006.01)
*F21S 13/12* (2006.01)

(52) U.S. Cl.
USPC ..... 362/457; 351/382; 351/458

(58) Field of Classification Search
USPC ..... 362/382, 457–457, 800
See application file for complete search history.

(56) References Cited

U.S. PATENT DOCUMENTS 6,969,273 B2 * 11/2005 Chen ..... 439/490

* cited by examiner

*Primary Examiner* — Jason Moon Han
(74) *Attorney, Agent, or Firm* — Snell & Wilmer LLP

(57) ABSTRACT

A proximity touch sensor device having an inner housing defining a cavity, an integrated circuit positioned within the cavity of the inner housing, the integrated circuit having an input port and an output port that outputs an output signal, and a USB connector protruding from the inner housing. The proximity touch sensor device also includes a light emitting diode integrated into the inner housing, positioned above the USB connector and electrically coupled to the output port of the integrated circuit, a sensing device positioned around the inner housing and electrically coupled to the input port of the integrated circuit, and an outer housing completely covering the inner housing and the sensing device such that contact with the outer housing causes the sensing device to send a signal to the input port of the integrated circuit to activate the light emitting diode.

20 Claims, 7 Drawing Sheets

| MOD | AHL | OPTION FEATURES |
|---|---|---|
| 0 | 0 | DIRECT MODE, ACTIVE HIGH OUTPUT |
| 0 | 1 | DIRECT MODE, ACTIVE LOW OUTPUT |
| 1 | 0 | TOGGLE MODE, POWER ON STATE=0 |
| 1 | 1 | TOGGLE MODE, POWER ON STATE=1 |

FIG. 2

PROXIMITY TOUCH SENSOR CABLE WITH A LIGHT EMITTING DIODE

BACKGROUND

1. Field

The present disclosure relates to sensor cables for electronic devices, and more particularly, to a proximity touch sensor cable with a light emitting diode (LED).

2. Description of the Related Art

Most electronic devices have one or more ports that are used to charge, power and/or transfer data to and/or from the electronic devices. In many instances, the one or more ports are difficult to access, view and/or see due to the location of these ports and/or in certain circumstances, due to the limited natural and artificial light present. Hence, users tend to experience difficulty in properly plugging in various charging and/or data cables into these ports. For example, many users experience problems when trying to plug in their charger into their mobile device at night especially since there is insufficient light to see the cable and/or the port. Users generally end up bending or damaging the connector pins of the cable, the charger and/or the mobile device. If this occurs, the user is forced to buy a new cable or a new charger or get their mobile device repaired, if at all possible. Therefore, there is a need for providing cable connectors and charging connectors that solve the problems described above.

SUMMARY

The above needs are successfully met via the disclosed apparatuses and devices. The present disclosure relates to sensor cables for electronic devices, and more particularly, to a proximity touch sensor cable with a light emitting diode (LED). In one embodiment, the proximity touch sensor device has an inner housing defining a cavity, an integrated circuit positioned within the cavity of the inner housing, the integrated circuit having an input port and an output port that outputs an output signal, and a USB connector protruding from the inner housing. The proximity touch sensor device also includes a light emitting diode integrated into the inner housing, positioned above the USB connector and electrically coupled to the output port of the integrated circuit, a sensing device positioned around the inner housing and electrically coupled to the input port of the integrated circuit, and an outer housing completely covering the inner housing and the sensing device such that contact with the outer housing causes the sensing device to send a signal to the input port of the integrated circuit to activate the light emitting diode.

BRIEF DESCRIPTION OF THE DRAWINGS

The features and advantages of the embodiments of the present disclosure will become more apparent from the detailed description set forth below when taken in conjunction with the drawings. Naturally, the drawings and their associated descriptions illustrate example arrangements within the scope of the claims and do not limit the scope of the claims. Reference numbers are reused throughout the drawings to indicate correspondence between referenced elements.

FIG. 2 is a table showing different input settings for the AHL pin and the MOD pin for controlling the capacitive proximity device according to an embodiment of the present invention;

DETAILED DESCRIPTION

In the following detailed description, numerous specific details are set forth to provide an understanding of the present disclosure. It will be apparent, however, to one of ordinary skill in the art that elements of the present disclosure may be practiced without some of these specific details. In other instances, well-known structures and techniques have not been shown in detail to avoid unnecessarily obscuring the present disclosure.

Figure 1A:
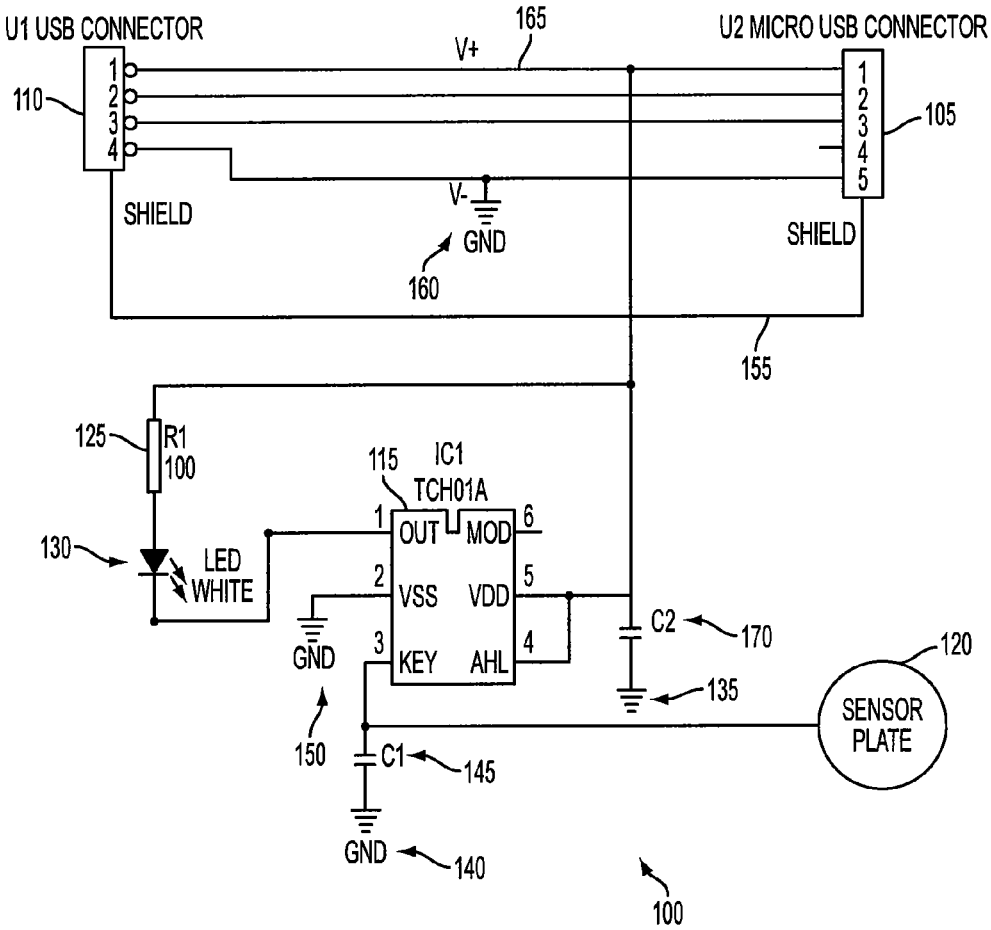
FIG. 1A is a schematic circuit diagram of a capacitive proximity device that uses digital methods to detect a change in capacitance on a sensing device according to an embodiment of the present invention.

FIG. 1A is a schematic circuit diagram of a capacitive proximity device 100 (also can be referred to as a capacitive proximity touch sensor 100) that uses digital methods to detect a change in capacitance on a sensing device 120. The capacitive proximity device 100 includes an integrated circuit 115, a sensing device 120, a resistor 125, a light emitting diode (LED) 130, a first capacitor (C1) 145, and a second capacitor (C2) 170. The LED 130 may be a light bulb, or other light device. Some or all of these components can be mounted on a printed circuit board 905 (shown in FIG. 9) and placed inside an inner housing 710 (shown in FIG. 9). The capacitive proximity device 100 may include a shield 155 to ground any noise created by these components or external components or devices.

The integrated circuit 115 includes 6 contacts, ports or pins. An example of the integrated circuit 115 is model number TCH01A integrated circuit. The 6 pins may include an OUT (output) pin 1, a Vss (ground) pin 2, a KEY pin 3, an AHL pin 4, a Vdd (power) pin 5, and a MOD pin 6. The OUT pin 1 is connected to the LED 130. More specifically, a first end of the LED 130 is connected to the resistor 125 and a second end of the LED 130 is connected to the OUT pin 1 of the integrated circuit 115. A first end of the resistor 125 is connected directly to a power source (e.g., 5 volts) from a USB connector 110 and a second end of the resistor 125 is connected to the first end of the LED 130. As an example, the resistor 125 has a value of about 100 ohms. The resistor 125 is used to control the current to the LED 130 in order to make the LED 130 brighter or dimmer depending on the value of the resistor 125. That is, the larger the value of the resistor 125, the dimmer the LED 130. Hence, the smaller the value of the resistor 125, the brighter the LED 130. The Vss pin 2 is connected to or tied to a ground 150.

The Vdd pin 5 is connected to a power supply 165 (e.g., 5 volts) from pin 1 of a micro USB connector 105 and/or pin 1 of the USB connector 110. That is, power from the micro USB connector 105 and/or the USB connector 110 is fed into the Vdd pin 5 to supply power to the integrated circuit 115. Therefore, the integrated circuit 115 does not need a separate power source (e.g., a battery) for power but rather taps power from the power supply 165 that supplies power to the micro USB connector 105 or the USB connector 110. The input Vdd pin 5 can be connected to a minimum of 2.0 Volts DC and a maximum of 5.5 Volts DC. This range enables the integrated circuit 115 to utilize the 5.0 Volts DC coming out from the standard USB connector output pin 1.

A first end of the first capacitor 145 is connected to the KEY pin 3 and the sensing device 120 and a second end of the first capacitor 145 is connected to a ground 140. As an example, the first capacitor 145 has a value of about 33 pF. The first capacitor 145 is used to control the sensitivity of the sensing device 120 and prevent false positives or starts of the LED 130. That is, the larger the value of the first capacitor 145, the less sensitive the sensing device 120 and the smaller the value of the first capacitor 145, the more sensitive the sensing device 120. The first capacitor 145 also functions to further improve RF immunity.

A first end of the second capacitor 170 is connected to the power from the power supply 165 and is connected to the Vdd pin 5 and the AHL pin 4. The AHL pin 4 and the Vdd pin 5 are connected together. A second end of the second capacitor 170 is connected to a ground 135. As an example, the second capacitor 170 has a value of about 100 nF. The second capacitor 170 is used to minimize the noise coming from the input voltage (e.g., the power supply 165).

The KEY pin 3 is connected to the sensing device 120 and the first capacitor 145. The integrated circuit 115 includes an oscillator 180 and an internal timing circuit 178 that generates, for example, 60 pulses per minute and outputs a pulse tone (each second) to a sensor circuit 175 (see FIG. 1B).

Figure 6:
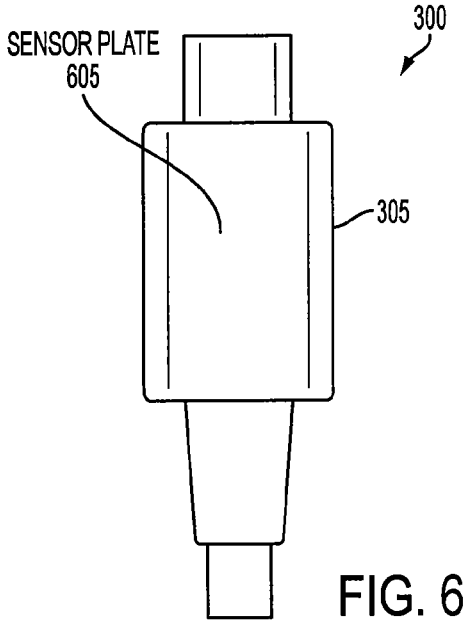
FIG. 6 is a top view of the proximity touch sensor cable of FIG. 3 with the LED integrated therein according to an embodiment of the present invention.
Figure 7A:
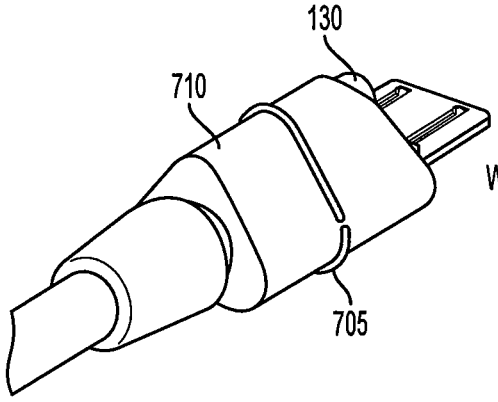
FIGS. 7A and 7B show the sensing device as a coaxial cable wrapped around the inner housing and the LED protruding from the inner housing according to an embodiment of the present invention.
Figure 7B:
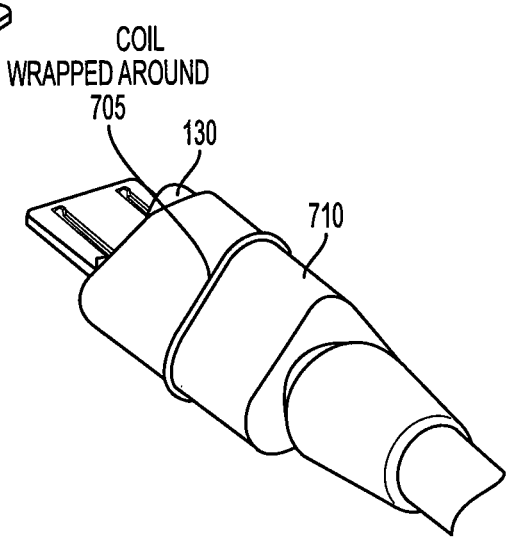

The sensing device 120 can include a sensor plate or a metal plate 605 (see FIG. 6), a coaxial cable, a coil and/or a wire 705 (see FIGS. 7A and 7B). In one embodiment, the sensing device 120 is a metal plate 605 that is connected to the KEY pin 3 of the integrated circuit 115 using a wire. In another embodiment, the sensing device 120 is a coaxial cable 705 that is connected to the KEY pin 3 of the integrated circuit 115. An internal low pass filter inside the coaxial cable 705 can be used to reduce RF interference.

Figure 1B:
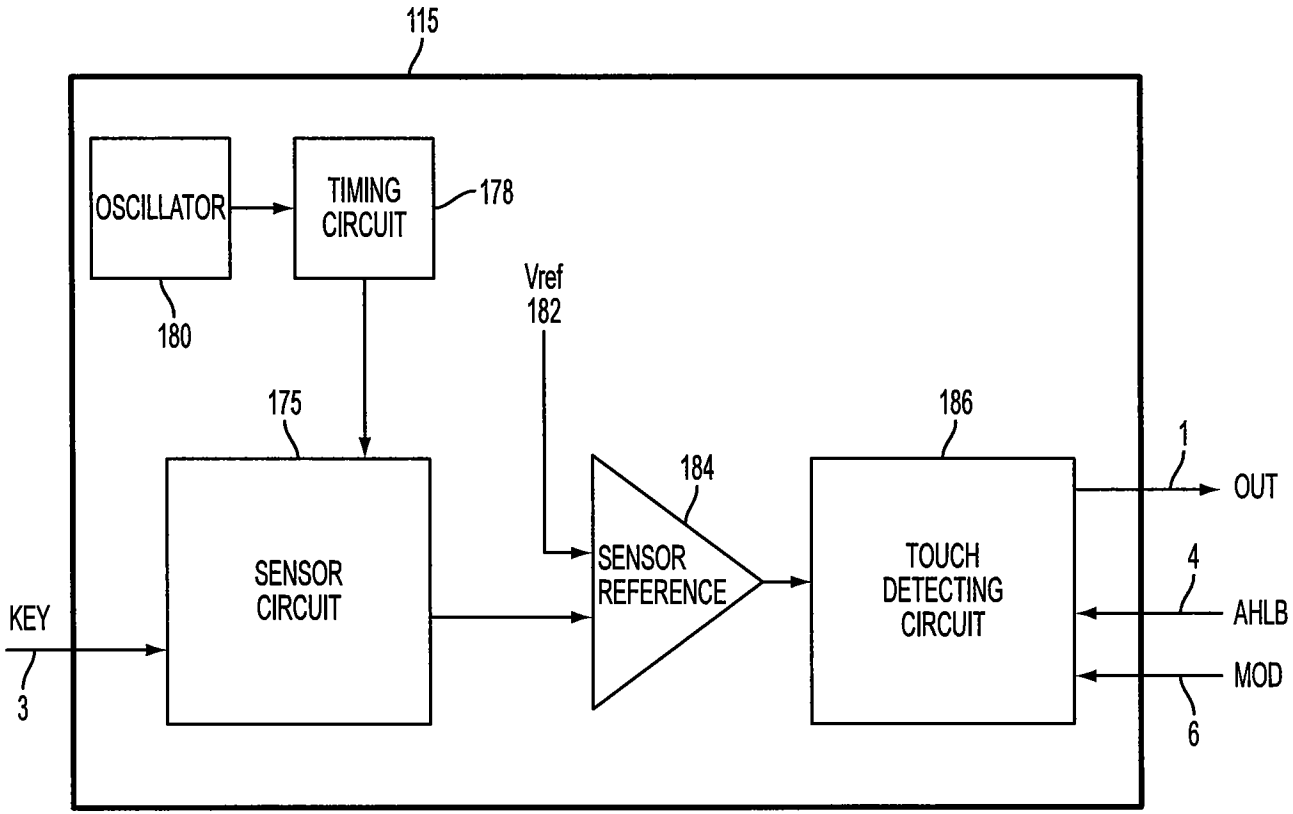
FIG. 1B is a schematic circuit diagram of the integrated circuit shown in FIG. 1A according to an embodiment of the present invention.

FIG. 1B is a schematic circuit diagram of the integrated circuit 115 shown in FIG. 1A. Referring to FIGS. 1A and 1B, the integrated circuit 115 may include a sensor circuit 175, a timing circuit 178, an oscillator 180, a voltage reference (Vref) input 182, a sensor reference 184, and a touch detecting circuit 186. The timing circuit 178, using a signal generated by the oscillator 180, generates a timing signal (or counter) for input into the sensor circuit 175. When a user touches the sensing device 120, the KEY pin 3 detects a change in capacitance received from the sensing device 120 and sends or propagates a signal to the sensor circuit 175. The signal (e.g., an active low signal) causes the output of the sensor circuit 175 to be altered. The sensor reference 184 (e.g., a comparator) compares the output of the sensor circuit 175 and the Vref input 182 and produces an output pulse or signal. If the output of the sensor circuit 175 falls below the Vref input 182, then the sensor reference 184 sends the output pulse or signal to activate the touch detecting circuit 186, which in turn activates the OUT pin 1. The touch detecting circuit 186 also receives input settings for the AHL pin 4 and the MOD pin 6 for controlling the capacitive proximity device 100. The OUT pin 1 is only activated when the output pulse or signal is sent to the touch detecting circuit 186. When the OUT pin 1 is activated, the LED 130 lights up.

FIG. 2 is a table showing different input settings for the AHL pin 4 and the MOD pin 6 for controlling the capacitive proximity device 100. Depending on whether the AHL pin 4 and the MOD pin 6 are tied high (Vdd) or low (Vss) as shown in FIG. 2, the capacitive proximity device 100 can operate in a number of different modes to activate and deactivate the LED 130. The different modes can be set or selected by the user or preset at the factory. The integrated circuit 115 has an active high output or an active low output or power on state by selecting or setting the AHL pin 4 to 0 or 1. The integrated circuit 115 has a direct mode or a toggle mode by selecting or setting the MOD pin 6 to 0 or 1. In the direct mode, the OUT pin 1 is active as long as the capacitive event lasts (e.g., the user continues touching the sensor plate 120). In the toggle mode, the OUT pin 1 is activated by the first capacitive event and deactivated by the following capacitive event (e.g., the user touches the sensor plate 120 to active the LED 130 and then touches the sensor plate 120 again to deactivate the LED 130).

Other integrated circuits can be used to provide a proximity touch sensor. For example, the touch sensor can be an inductive proximity sensor or an optical proximity sensor.

Figure 3:
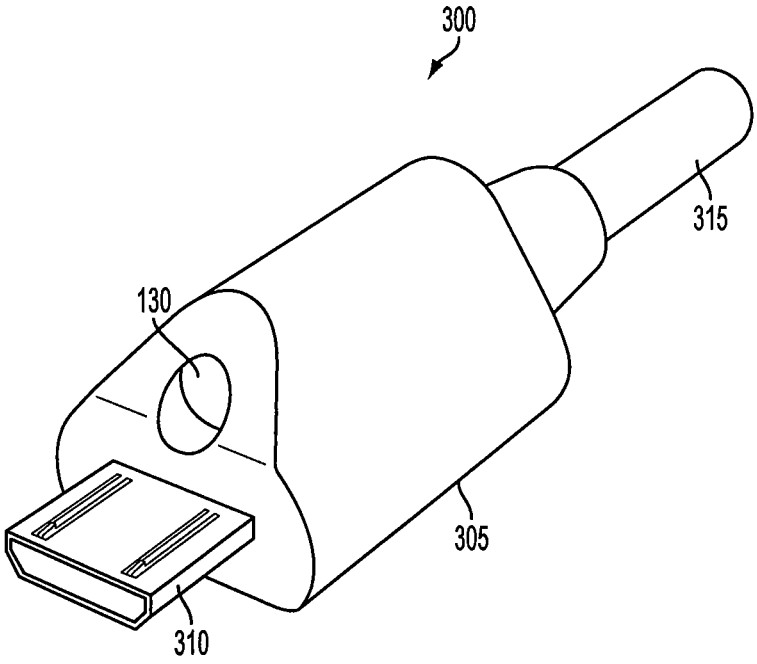
FIG. 3 is a perspective view of a proximity touch sensor cable with the LED integrated therein according to an embodiment of the present invention.

FIG. 3 is a perspective view of a proximity touch sensor cable 300 with the LED 130 integrated therein. The proximity touch sensor cable 300 may include an outer housing or mold 305, an inner housing or mold 710 (shown in FIGS. 7A, 7B and 9), the integrated circuit 115, the sensing device 120, the resistor 125, the LED 130, the first capacitor 145, the second capacitor 170, the printed circuit board 905, a connector 310 (e.g., a USB connector), and/or a cable 315. Other types of connectors can be used can be used in place of connector 310. The user touching or coming into close proximity to the outer housing 305, activates the sensing device 120 or causes the sensing device 120 to send a signal to the integrated circuit 115, which activates the LED 130. The LED 130 is activated by the proximity touch sensor 100. As shown, the LED 130 is integrated into the outer housing 305 and/or the inner housing 710. Integrating the LED 130 into the proximity touch sensor cable 300 allows for a compact, sleek, and versatile design. The LED 130 is slightly set back from a sloped front portion 405 (see FIG. 4) to prevent damage to the LED 130. The LED 130 can be activated by a manual push button switch located on or integrated into the outer housing 305 or by a touch sensor as described herein.

By designing and integrating the LED 130 into the proximity touch sensor cable 300, the user is able to activate the sensing device 120, which turns on the LED 130 so the user can see where the connector 310 is located and be able to connect it into the correct port and the correct direction and orientation without damaging the connector 310. The proximity touch sensor cable 300 can also be used as a flash light.

Figure 4:
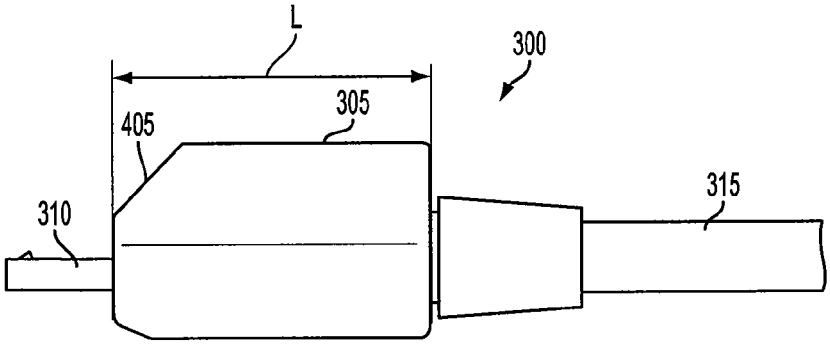
FIG. 4 is a side view of the proximity touch sensor cable of FIG. 3 with the LED integrated therein according to an embodiment of the present invention.
Figure 5:
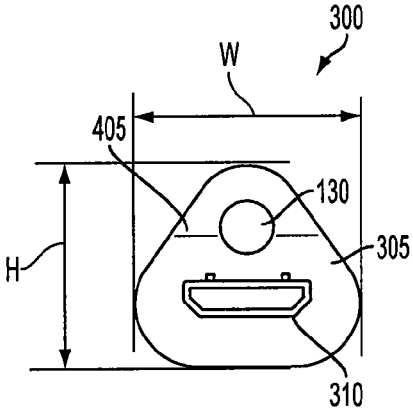
FIG. 5 is a front view of the proximity touch sensor cable of FIG. 3 with the LED integrated therein according to an embodiment of the present invention.

FIG. 4 is a side view of the proximity touch sensor cable 300 of FIG. 3 with the LED 130 integrated therein. FIG. 5 is a front view of the proximity touch sensor cable 300 of FIG. 3 with the LED 130 integrated therein. FIG. 6 is a top view of the proximity touch sensor cable 300 of FIG. 3 with the LED 130 integrated therein. Referring to FIGS. 4-6, the outer housing 305 has a sloped front portion 405 having an angle of between about 30 degrees to about 60 degrees and preferably about 45 degrees in an area where the LED 130 is integrated into the outer housing 305. The sloped front portion 405 in a rear direction allows the LED 130 to emit light in a more scattered way or direction (e.g., avoids the front face of the housing 305 from blocking the light) to allow for better viewing and connection of the connector 310. The sloped front portion 405 is also used to avoid interference with the device to be connected to (e.g., a handset, a computer or other electronic device) and allow for easier removal of the proximity touch sensor cable 300 from the device to be connected to. In one embodiment, the outer housing 305 has a length L of 18.0 mm, a height H of 11.0 mm, and a width W of 12.2 mm. As shown in the front view (FIG. 5), the outer housing 305 is formed in the shape of a triangle with rounded corners or edges. The LED 130 is positioned adjacent to or above the connector 310. The sensing device 120 (e.g., a sensor plate 605) may be positioned underneath the outer housing 305 and between the outer housing 305 and the inner housing 710 so that it is not visible to the user.

FIGS. 7A and 7B show the sensing device 120 as a coaxial cable or a coil 705 wrapped around the inner housing 710 and the LED 130 protruding from the inner housing 710. The coaxial cable 705 is wrapped around the inner housing 710 which enables the user to activate the LED 130 by touching any side or portion of the outer housing 305, which completely covers the coaxial cable 705 and the inner housing 710. The inner housing 710 and the outer housing 305 are made from a rubber or plastic non-conductive material.

Figure 8:
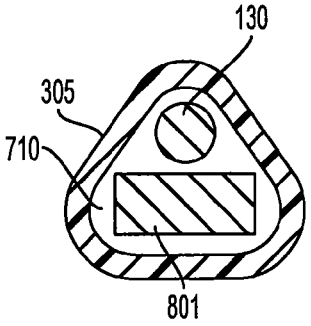
FIG. 8 is a cross-sectional front view of the proximity touch sensor cable of FIG. 3 showing some of the internal components according to an embodiment of the present invention.

FIG. 8 is a cross-sectional front view of the proximity touch sensor cable 300 of FIG. 3 showing some of the internal components. The inner housing 710 defines a cavity 801 for holding one or more of the following components: the integrated circuit 115, the sensing device 120, the resistor 125, the LED 130, the first capacitor 145, and/or the second capacitor 170. As shown, the LED 130 may also be positioned above the cavity 801.

Figure 9:
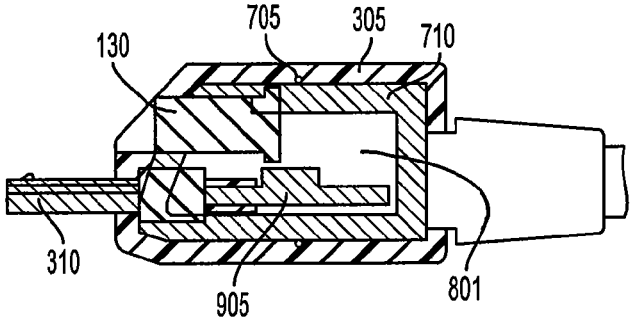
FIG. 9 is a cross-sectional side view of the proximity touch sensor cable of FIG. 3 showing some of the internal components according to an embodiment of the present invention.

FIG. 9 is a cross-sectional side view of the proximity touch sensor cable 300 of FIG. 3 showing some of the internal components. The LED 130 may also be tilted slightly (e.g., 1-10 degrees) in a downward direction towards the connector 310 to allow for the light from the LED 130 to be directed more towards the port into which the connector 310 fits into.

Those of ordinary skill will appreciate that the various illustrative logical blocks and process steps described in connection with the examples disclosed herein may be implemented as electronic hardware, computer software, or combinations of both. Whether such functionality is implemented as hardware or software depends upon the particular application and design constraints imposed on the overall system. Ordinarily skilled artisans may implement the described functionality in varying ways for each particular application, but such implementation decisions should not be interpreted as causing a departure from the scope of the disclosed apparatus and methods.

The foregoing description of the disclosed example embodiments is provided to enable any person of ordinary skill in the art to make or use the present invention. Various modifications to these examples will be readily apparent to those of ordinary skill in the art, and the principles disclosed herein may be applied to other examples without departing from the spirit or scope of the present invention. The described embodiments are to be considered in all respects only as illustrative and not restrictive and the scope of the invention is, therefore, indicated by the following claims rather than by the foregoing description. All changes which come within the meaning and range of equivalency of the claims are to be embraced within their scope.

What is claimed is:

1. A proximity touch sensor device comprising:

an inner housing at an end of a cable defining a cavity;

an integrated circuit positioned within the cavity of the inner housing, the integrated circuit having an input port and an output port that outputs an output signal;

a USB connector protruding from the inner housing;

a light emitting diode positioned in the inner housing, positioned adjacent to the USB connector and electrically coupled to the output port of the integrated circuit;

a sensing device positioned around the inner housing and electrically coupled to the input port of the integrated circuit; and an outer housing completely covering the inner housing and the sensing device such that contact with the outer housing causes the sensing device to send a signal to the input port of the integrated circuit to activate the light emitting diode.

2. The proximity touch sensor device of claim 1 wherein the USB connector is connected to a power source.

3. The proximity touch sensor device of claim 2 wherein the integrated circuit receives power from the same power source that is used to power the USB connector.

4. The proximity touch sensor device of claim 2 further comprising a resistor having a first end connected to the power source and a second end connected to the light emitting diode.

5. The proximity touch sensor device of claim 3 wherein the resistor is used to control the current to the light emitting diode in order to make the light emitting diode brighter or dimmer.

6. The proximity touch sensor device of claim 1 wherein the sensing device is a metal plate, a coaxial cable, a coil or a wire.

7. The proximity touch sensor device of claim 1 further comprising a first capacitor having a first end electrically coupled to the input port of the integrated circuit and a second end electrically coupled to a ground.

8. The proximity touch sensor device of claim 7 wherein the first capacitor is used to control the sensitivity of the sensing device and prevent false positives or starts of the light emitting diode.

9. The proximity touch sensor device of claim 7 further comprising a second capacitor having a first end electrically coupled to the power source and a second end electrically coupled to a ground.

10. The proximity touch sensor device of claim 9 wherein the second capacitor is used to reduce the noise from the power source.

11. The proximity touch sensor device of claim 1 wherein the outer housing is formed in the shape of a triangle having rounded or curved edges.

12. The proximity touch sensor device of claim 11 wherein the outer housing has a sloped front portion having an angle of between about 30 degrees to about 60 degrees in an area where the light emitting diode is positioned.

13. The proximity touch sensor device of claim 1 wherein the light emitting diode is positioned to point in a downward direction with an angle of between about 1 degree to about 10 degrees.

14. A proximity touch sensor device comprising:

an inner housing at an end of a cable defining a cavity;

an integrated circuit positioned within the cavity of the inner housing, the integrated circuit having an input port and an output port that outputs an output signal;

a USB connector protruding from the inner housing;

a light positioned in the inner housing, positioned adjacent to the USB connector and electrically coupled to the output port of the integrated circuit;

a wire positioned around the inner housing and electrically coupled to the input port of the integrated circuit; and an outer housing covering the inner housing and the wire so that contact with the outer housing causes the wire to propagate a signal to the input port of the integrated circuit to activate the light.

15. The proximity touch sensor device of claim 14 wherein the USB connector is connected to a power source.

16. The proximity touch sensor device of claim 15 wherein the integrated circuit receives power from the same power source that is used to power the USB connector.

17. The proximity touch sensor device of claim 15 further comprising a resistor having a first end connected to the power source and a second end connected to the light.

18. The proximity touch sensor device of claim 14 further comprising a first capacitor having a first end electrically coupled to the input port of the integrated circuit and a second end electrically coupled to a ground.

19. The proximity touch sensor device of claim 18 further comprising a second capacitor having a first end electrically coupled to the power source and a second end electrically coupled to a ground.

20. The proximity touch sensor device of claim 14 wherein the outer housing is formed in the shape of a triangle having rounded or curved edges and the outer housing has a sloped front portion having an angle of between about 30 degrees to about 60 degrees in an area where the light is positioned.

* * * * *